United States Patent [19]

Deutsch

[11] 4,122,742

[45] Oct. 31, 1978

[54] TRANSIENT VOICE GENERATOR

[75] Inventor: Ralph Deutsch, Sherman Oaks, Calif.

[73] Assignee: Deutsch Research Laboratories, Ltd., Sherman Oaks, Calif.

[21] Appl. No.: 711,397

[22] Filed: Aug. 3, 1976

[51] Int. Cl.[2] ..... G10H 3/00

[52] U.S. Cl. ..... 84/1.11; 84/1.19; 84/1.24

[58] Field of Search ..... 84/1.24, 1.26, 1.13, 84/1.11, 1.19, 1.12, 1.21, DIG. 5

[56] References Cited

U.S. PATENT DOCUMENTS

| | | | |
|---|---|---|---|
| 3,740,450 | 6/1973 | Deutsch | 84/1.24 |
| 3,854,365 | 12/1974 | Tomisawa et al. | 84/1.03 X |
| 3,908,504 | 9/1975 | Deutsch | 84/1.26 X |
| 3,913,442 | 10/1975 | Deutsch | 84/1.26 X |

*Primary Examiner*—Ulysses Weldon
*Attorney, Agent, or Firm*—Ralph Deutsch

[57] ABSTRACT

Musical notes having time variant modification of the waveshape are produced polyphonically in a tone synthesizer by computing master and transient data sets, transferring these data to buffer memories, adding the data read out from the buffer memories briefly during a transient time interval and repetitively converting the summed data to waveforms. The master and transient data set are created repetitively and independently of tone generation by computing a generalized Fourier algorithm using stored sets of generalized Fourier coefficients. Circuitry is disclosed for independently applying Attack/Release modulations to the principal tone generated from the master data set and to the transient tone generated from the transient data set.

9 Claims, 8 Drawing Figures

TRANSIENT VOICE GENERATOR

BACKGROUND OF THE INVENTION

1. Field of the Invention

The present invention relates to the production of time variant modifications to the musical waveshape produced in a musical tone synthesizer.

2. Description of the Prior Art

A feature commonly used in electronic organs designed for popular music is the so-called "percussive voice." This is a composite voice including a first tone having a piano-like attack/release envelope played in combination with an organ-like sustained tone. The effect is a transient percussive sound at the onset of tonal production.

A well-known phenomena occurs in pipe organs and is called "chiff." In a wind-blown organ pipe a frequency instability occurs during the build-up of the tone. The instability is approximated by a predominant sound component at the third or fifth harmonic of the pipe's fundamental frequency. This predominant harmonic is transient and quickly diminishes in relative intensity as the nominal fundamental frequency for the pipe begins to "speak" distinctly.

Electronic organs imitate chiff by playing a short grace note at the onset of tone production. The grace note is generated by actuating a 2 $\frac{2}{3}$-foot coupler for the duration of the nominal attack time for the 8-foot tone which is to be chiffed. Customarily, chiff is used only on diapason and flute tones which are characterized by a spectral composition of very few harmonic components.

The inventor's U.S. Pat. No. 3,740,450 discloses apparatus for producing chiff tones in a digital organ of the type wherein a musical waveshape in repetitively read out from storage at a rate related to the selected note. A chiffing waveshape is stored in a separate memory that is accessed during the attack portion of the primary tone. The separate waveshape memory outputs are combined to produce the chiffed musical tone.

The inventor's U.S. Pat. No. 3,913,442 discloses apparatus for producing chiff tones in an organ of the type described as a Computor Organ in U.S. Pat. No. 3,809,786. In such an instrument, musical tones are produced by computing in real time the amplitudes X(*g*R) at successive sample points gR of a musical waveshape, and converting these amplitudes to tones as the computations are carried out. The tonal quality of the generated note is established by a set of harmonic coefficients. Transient voices are obtained by adding selected harmonics to the set of harmonic coefficients for a short interval at the onset of the generated waveshape.

One object of the present invention is to implement the production of such transient voices in a polyphonic tone synthesizer. Another object is to produce chiff in a polyphonic tone synthesizer.

SUMMARY OF THE INVENTION

In a Polyphonic Tone Synthesizer of the type described in U.S. Pat. No. 4,085,644 (filed Aug. 11, 1975), a computation cycle and a data transfer cycle are repetitively and independently implemented to provide data which is converted to musical notes. During the computation cycle a master data and a transient data set are created by implementing a discrete Fourier algorithm using a stored set of harmonic coefficients which characterize the basic musical tone and a second stored set of harmonic coefficients which characterize the transient voice. The computations are carried out at a fast rate which may be nonsynchronous with any musical frequency.

Following a computation cycle, a transfer cycle is initiated which transfers the master and transient data sets to a multiplicity of read-write memories. The transfer for each memory is initiated by detection of a synchronizing bit and is timed by an assigned selected clock which may be asynchronous with the main system logic clock. The frequency of the assigned clock is Pf, where f is the frequency of a particular note assigned to a memory and P is two times the maximum number of harmonics in the musical waveshape. The transfer cycle is completed when all the memories have been loaded, at which time a new computation cycle is initiated. Tone generation continues uninterrupted during computation and transfer cycles. A digital-to-analog convertor transforms the data read out of the memories to analog voltages representing the musical waveshapes.

Provision is made for combining the numbers in the master and transient data sets during the initial onset of the principal tone to produce the musical effect of a transient combination of tones which later changes to only the principal tone. Further provision is made so that the transient data is modulated to produce a transient voice having independent amplitude modulation from that of the principal tone.

BRIEF DESCRIPTION OF THE DRAWINGS

A detailed description of the invention will be made with reference to the accompanying drawings, wherein like numerals designate like components in the several figures.

DESCRIPTION OF THE PREFERRED EMBODIMENT

The following detailed description is of the best presently contemplated modes of carrying out the invention. This description is not to be taken in a limiting sense, but is merely for the purpose of illustrating the general principles of the invention since the scope of the invention is best defined by the appended claims. Structural and operational characteristics attributed to forms of the invention first described shall also be attributed to forms later described, unless such characteristics are obviously inapplicable or unless specific exception is made.

The transient generator disclosed herein operates in conjunction with musical tone generators of the type wherein the tone generator incorporates means for computing wave shapes from stored tables of harmonic coefficients. The transient generator will be described in conjunction with the Polyphonic Tone Synthesizer disclosed in U.S. Pat. No. 4,085,644 (filed Aug. 11, 1975), incorporated herein by reference.

In the Polyphonic Tone Synthesizer a computation cycle and data transfer cycle are repetitively and independently implemented to provide data which is converted to musical notes. During the computation cycle a master data set is created by implementing a discrete generalized Fourier algorithm using a stored set of harmonic coefficients which characterize the basic musical tone. Preferably, the harmonic coefficients and the orthogonal functions are stored in digital form, and the computations are carried out digitally. At the end of the computation cycle a master data set has been created and is temporarily stored in a data register.

Following a computation cycle, a transfer cycle is initiated which transfers the master data set to a multiplicity of read-write memories. The transfer for each memory is initiated by detection of a synchronizing bit and is timed by a clock which may be asynchronous with the main system clock and has a frequency $Pf$, where $f$ is the frequency of a particular note assigned to a memory and P is at least two times the maximum number of harmonics in the musical waveshape. The transfer cycle is completed when all the memories have been loaded, at which time a new computation cycle is initiated. Tone generation continues uninterrupted during computation and transfer cycles.

Figure 1:
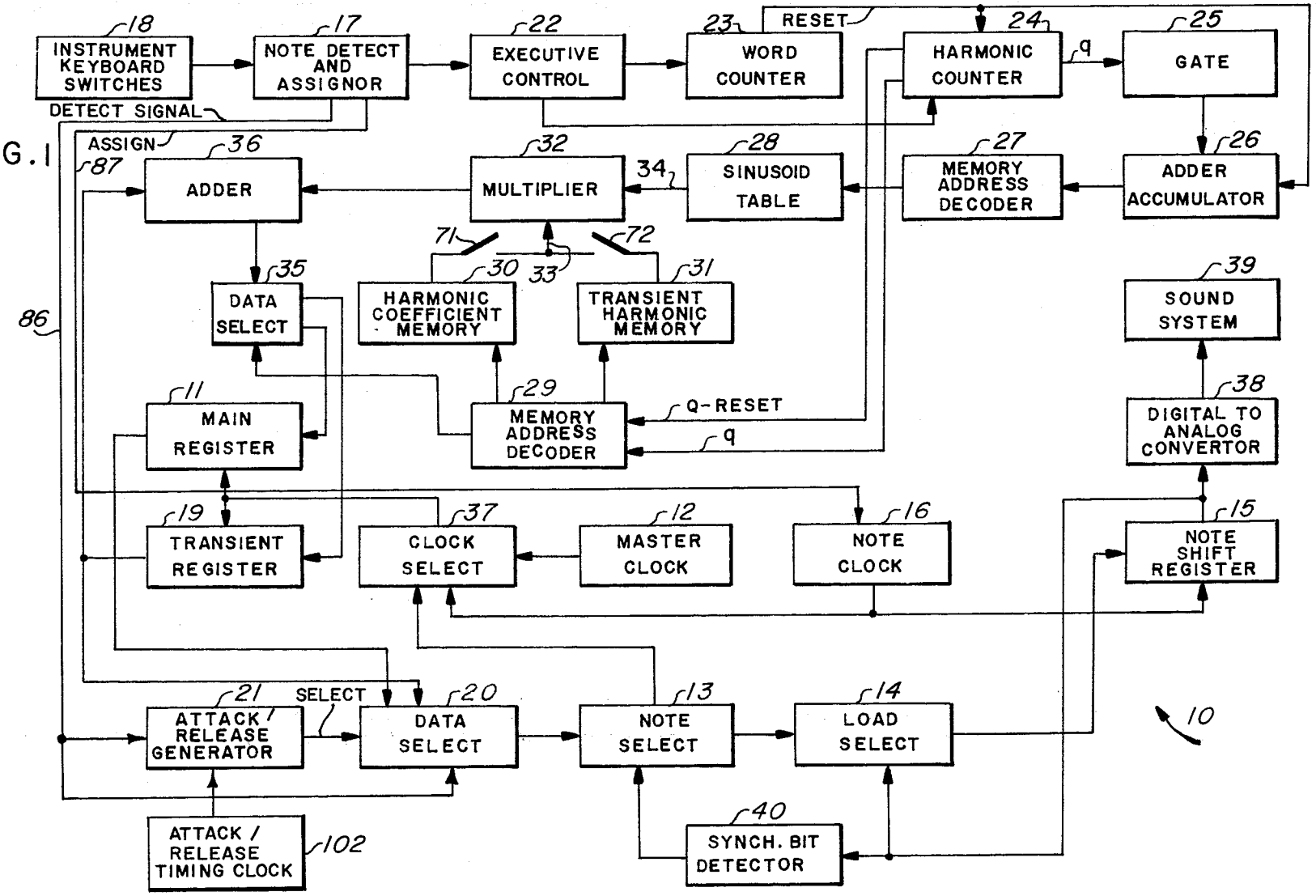
FIG. 1 is an electrical block diagram of a polyphonic tone synthesizer configured to produce transient voice effect.

System 10 of FIG. 1 illustrated the Transient Voice Generator used in conjunction with the Polyphonic Tone Synthesizer. In the Polyphonic Tone Synthesizer a master data set is created in Main Register 11. The system logic is timed by Master Clock 12 while the master data set is generated. After the completion of the generation of the master data set, the data is transferred via Note Select 13 to an assigned Load Select; for example, Load Select 14. From the assigned Load Select 14, the data is in turn loaded into a corresponding Note Shift Register 15. The transfer and subsequent data loading is accomplished by means of a Note Clock 16 which has been assigned by Note Detect and Assignor 17 to generate a frequency corresponding to an actuated key on the Instrument Keyboard Switches 18.

A second master data set, called the transient data set, is created and stored in Transient Register 19. The transient data set is usually generated from a different set of harmonic coefficients than those used to generate the master data set. The contents of Transient Register 19 are transferred to Load Select 14 via Data Select 20 under timing control of Note Clock 16. Data Select 20 is controlled by the combined action of Note Detect and Assignor 17 and Attack/Release Generator 21 in such a manner than during the attack interval of a generated musical note, the data residing in Transient Register 19 is transferred to Note Select 13 and following the attack interval the data residing in Main Register 11 is transferred to Note Select 13. In this fashion the transient voice is created during the attack time interval of a note and is removed at a specified interval following the detection of a note; being replaced by the voice corresponding to the data residing in the Main Register 11.

The master data set and the transient data set are created during a computation cycle. The system timing and control functions are accomplished within the Executive Control 22. The master data set is computed according to the relation $$Z(N) = \sum_{q=1}^{W} c_q \sin(2\pi Nq/2W) \qquad \text{(Equation 1)}$$

for values of $N=1,2,3,\ldots,2W$. The transient data set is computed according to the relation $$T(N) = \sum_{q=1}^{W} c_q \sin(\pi Nq/W) + \sum_{q=1}^{U} d_q \sin(\pi Ng/W \qquad \text{(Equation 2)}$$

where the number of harmonics U is less than or equal to the number of harmonics W used to compute the master data set. $q$ is the order of the harmonic and $c_q$ and $d_q$ are members of two sets of harmonic coefficients. U is the number of harmonic components defining the transient voice constituent of the transient data set. Notice, in the implementation of System 10 shown in FIG. 1, that the elements of the transient data set T(N) contain the elements of the master data set Z(N) plus additional terms.

While the invention is illustrated for the combination of two tones, one corresponding to the harmonic coefficients $c_q$ and the other corresponding to the harmonic coefficients $d_q$, the invention can be readily extended to any plurality of combination of tones. Tone switches 33*a*, 33*b*, . . . , 33*k* shown in FIG. 1 illustrate a set of tone setting stop switches which can be operated in combination to cause the tone to be a combination of a plurality of tones in a manner described in detail in the above identified patent application Ser. No. 603,776. The number of harmonics W is a design choice. The use of 32 harmonics (W=32) is satisfactory for synthesizing the "bright" tonal sounds of a musical tone synthesizer.

Whenever a switch is actuated on Instrument Keyboard Switches 18, its actuation is detected by Note Detect and Assignor 17. The detector of an actuated key causes the assignment of a temporary memory position in 17 containing data that identifies which particular key has been actuated. Note Detect and Assignor 17 transmits to Executive Control 22 the information that a key switch has been detected as having been actuated on Instrument Keyboard Switches 18.

Means for implementing Note Detect and Assignor 17 are described in U.S. Pat. No. 4,022,098 entitled *KEYBOARD SWITCH DETECT AND ASSIGNOR*, incorporated herein by reference.

The logic timing for System 10 of FIG. 1 is furnished by Master Clock 12. A fairly wide range of frequencies can be used for Master Clock 12; however advantageously a design choice is 1 Mhz.

Executive Control 22 transmits control signals to several of the system logic blocks to synchronously time various system logic functions.

The computation cycle is a repetitive event during which data sets are computed according to Equation 1 and Equation 2. The computation cycle is composed of two subcycles (or subcomputation cycles); the first allocated to the computation of Equation 1 and the second allocated to completing the computation of Equation 2. At the beginning of a computation cycle Word Counter 23, Harmonic Counter 24, and Adder-Accumulator 26 are all initialized to a value of "1" by Executive Control 22.

At time $t=t_1$, corresponding to the first bit time of the computation cycle, Word Counter 23 has the value one as its content. Harmonic Counter 24 also contains the value "one." The number contained in Harmonic Counter 24 is transmitted via Gate 25 to Adder-Accumulator 26 at time $t_1$. Memory Address Decoder 27 receives the number $Nq=1\times1$ from Adder-Accumulator 26 and causes the value $S_{1,1}=\sin[\pi(1\times1)/W]$ to be read out from Sinusoid Table 28. At each bit time Adder-Accumulator 26 receives the current content $q$ of Harmonic Counter 24 and adds this received value to the value it contains thereby accumulating the value of $N\times q$.

Memory Address Decoder 29 receives the Q-Reset signal generated when the contents of Harmonic Counter 24 are reset to the initial value of one. Upon receiving the Q-Reset signal, Memory Address Decoder 29 switches its function of addressing harmonic coefficients $c_q$ from Harmonic Coefficient Memory 30 to that of addressing harmonic coefficients $d_q$ from Transient Harmonic Memory 31. Thus for the first subcycle of the computation cycle, Memory Address Decoder 29 addresses the appropriate harmonic coefficients $c_q$ corresponding to the contents of Harmonic Counter 24 at each bit time and then when the Q-Reset signal is generated at the start of the second subcycle, Memory Address Decoder 29 addresses the appropriate harmonic coefficients $d_q$.

At time $t_1$, Memory Address Decoder 29 causes the harmonic coefficient $c_1$ to be read from Harmonic coefficient Memory 30. The input signals to Multiplier 32 are $c_1$ on line 33 and $S_{1,1}$ on line 34. Therefore, the output of Multiplier 32 is the product term $c_1S_{1,1}$.

Main Register 11 and Transient Register 19 are a set of read-write registers, which advantageously may comprise end-around shift registers. The contents of both Main Register 11 and Transient Register 19 are initialized to zero value at the start of a computation cycle. During the entire computation cycle the contents of Transient Register 19 are read out in response to the number N contained in Word Counter 23. The data read out of Transient Register 19 are added by Adder 36 to the product data produced by Multiplier 32. Data Select 35 transfers the sums produced by Adder 36 to Transient Register 19 during the entire computation cycle. The sums received by Transient Register 19 are caused to be stored in a memory location corresponding to the current number N in Word Counter 23.

Data Select 35 causes the sums from Adder 36 also to be sent to Main Register 11. These sums are stored in a memory location of Main register 11 corresponding to the current number N in Word Counter 23. During the second subcycle of the computation cycle, Data Select 35 is caused to inhibit data from being transferred and stored in Main Register 11. Hence at bit time $t_1$ in the computation cycle the value $c_1S_{1,1}$ is stored in the memory address corresponding to $N=1$ in both Main Register 11 and Transient Register 19.

At the second bit time $t_2$ in the computation cycle, Word Counter 23 is incremented to the value $N=2$ by a signal received from Executive Control 22. The contents of Harmonic Counter 24 remain at the value $q=1$ and will retain this value during the first 64 bit times of the computation cycle. Adder-Accumulator 26 receives the current value of $q$ from Harmonic Counter 24 via Gate 25 at each bit time. Therefore at time $t_2$, Adder-Accumulator 26 has the value $Nq=2$. The value $Nq=2$ is transmitted to Memory Address Decoder 27 which, in turn, causes the value $S_{2,1=sin[\pi(2\times1)/W]}$ to be addressed out from Sinusoid Table 28. At time $t_2$, the harmonic coefficient $c_1$ is read from Harmonic Coefficient Memory 30. The output signal from Multiplier 32 is the value $c_1S_{2,1}$ which is added by Adder 36 to the invention zero value of the word at the address corresponding to $N=2$ in both Main Register 11 and Transient Memory 19.

The action described above is iterated for 64 bit times during each of which the value $q=1$ is kept constant. The net result is at time $t_{64}$ the contents of both Main Register 11 and Transient Register 19 contain the set of values $$c_1S_{1,1},\ c_1S_{2,1},\ \ldots,\ c_1S_{64,1}$$

where $S_{k,1}=\sin[\pi(k\times1)/W]$.

At time $t_{65}$, Word Counter 23 returns to its initial value of one and generates a Reset signal because this device is a counter modulo 2W, and W has been selected to have the value 32. The resetting of Word Counter 23 is detected from the Reset signal by Adder-Accumulator 26 and causes the accumulator to return to an initial value of zero. The Reset signal from Word Counter 23 is used to increment the counter in Harmonic Counter 24 so that it now contains the value $q=2$. Harmonic Counter 24 will retain the value of $q=2$ for 64 successive bit times. Therefore at time $t_{65}$, Adder-Accumulator 26 has the value $Nq=2$ and transmits this value to Memory Address Decoder 27 which, in turn, causes the value $S_{1,2}=\sin[\pi(1\times2)/W]$ to be read out of Sinusoid Table 28. At time $t_{65}$, the harmonic coefficient $c_2$ is read out from Harmonic Coefficient Memory 30. The output signal from Multiplier 32 is the value $c_2S_{1,2}$ which is added to the value $c_1S_{1,1}$. This is the value which at time $t_{65}$ is read out of Transient Register 19 and sent to Adder 36. The net result is that the sum $c_1S_{1,1}+c_2S_{1,2}$ is placed in storage in word $N=1$ in both Main Register 11 and Transient Memory 19 at time $t_{65}$.

The preceding described operation starting at time $t_{65}$ is iterated for 64 successive bit times during which the value $q=2$ is kept constant. The net result is that the contents of both Main Register 11 and Transient Register 19 contain the set of values $$c_1S_{1,1}+c_2S_{1,2},\ c_1S_{2,1}+c_2S_{2,2},\ \ldots,\ c_1S_{64,1}+c_2S_{64,2}.$$

At time $t_{129}$ Word Counter 23 returns to its initial value of one and again generates a Reset signal. The Reset signal causes Adder-Accumulator 26 to be initialized to a zero value and also causes an increment in Harmonic Counter 24. Harmonic Counter 24 now contains the value of $q=3$ and retains this value for the next successive 64 bit times. At the end of this sequence of 64 bit times, the contents of both Main Register 11 and Transient Register 19 are the set of values $$c_1S_{1,1}+c_2S_{1,2}+c_3S_{1,3},\ \ldots,\ c_1S_{64,1}+c_2S_{64,2}+c_3S_{64,3}.$$

The action described above is successively iterated for 32 sets of 64 bit times. At the end of $32\times64=2048$ bit times, the contents of both Main Register 11 and Transient Register 19 are those indicated in Equation 1.

Harmonic Counter 24 is a counter modulo 32. At time $t_{2094}$, Harmonic Counter 24 is reset to an initial value of one. At this time, the Harmonic Counter generates a Q-Reset signal. The Q-Reset signal causes Memory Address Decoder 29 to stop addressing coefficients from Harmonic Coefficient Memory 30 and to address coefficients $d_q$ from Transient Harmonic Memory 31 for the remainder of the computation cycle. Memory Address Decoder 29, upon receipt of the Q-Reset signal causes Data Select 35 to inhibit data output of Adder 36 from reaching Main Register 11 during the remainder of the computation cycle.

From time $t = 2049$ for another $t = 32 \times U$ bit times (U is the number of harmonics in the second term of Equation 2), the remainder of the system operates in an analogous manner to that described above. The difference being that now the coefficients $d_q$ are an input to Multiplier 32 and the terms summed by Adder 36 are only added to the data already contained in Transient Register 19. At the end of the computation cycle Main Register 11 contains data as indicated by Equation 1 and Transient Register 19 contains data as indicated by Equation 2. At the completion of the computation cycle, Executive Control 22 initiates the start of a data transfer cycle. During the attack time interval of the musical note, the contents of Transient Register 19 are transferred in a controlled manner to Note Shift Register 15. After the attack time interval, the contents of Main Register 11 are then transferred in a controlled manner to Note Shift Register 15. While the description of the data transfer cycle is illustrateed for a single note shift register, the extension to any multiplicity of note shift registers is apparent to those skilled in the art of logic design. The above referenced patent application Ser. No. 603,776 describes the data transfer cycle for a multiplicity of note shift registers.

The choice of the data set to be transferred to Note Shift Register 15 is accomplished by Data Select 20. Data select 20 is controlled by signals received from Attack/Release Generator 21. During the attack interval, Attack/Release Generator 21 receives a detect signal from Note Detect and assignor 17. The attack interval of the musical note is timed by Attack/Release Timing Clock 102 which can be a variable rate clock controlled in rate by the musician.

A means for advantageously implementing the Attack/Release Generator is described in copending U.S. Pat. No. 4,079,650 filed on Jan. 26, 1976 entitled ADSR Envelope Generator, incorporated herein by reference. Attack/Release generators are frequently called by synonymous terms such as ADSR generators and envelope generators. As described in the referenced patent, the ADSR Envelope Generator creates a signal at the completion of the envelope generation. This signal is used as the "select" signal shown in FIG. 1 as the input to Data Select 20.

Each note shift register, such as Note Shift Register 15 shown in FIG. 1, contains a bit position in each data word which is used for data synchronization. One data word has a "1" in the synchronization bits while the remainder contain "0." The synchronizing bit is used by various logic blocks to detect the initial phase of the end-around shift registers which are advantageously used to implement the note shift registers.

When a first key has been actuated on the Instrument Keyboard Switches 18, Note Clock 16 is assigned by Note Detect and Assignor 17. Note Clock 16 is caused to run at a frequency corresponding to the key switch that has been actuated. Note Detect and Assignor 17 when it detects the closure of a keyboard switch causes a transfer of a control voltage, or detection signal, to the assigned Note Clock 16 which causes the clock to operate at a rate 64 times the fundamental frequency assigned to the musical note.

A preferred implementation is to use a VCO (Voltage Controlled Oscillator) for Note Clock 16. Means for advantageously implementing a VCO are described in U.S. Pat. No. 4,067,254 entitled FREQUENCY NUMBER CONTROLLED CLOCKS, incorporated herein by reference.

Note Clock 16 causes Note Shift Register 15 to transfer data end-around at the assigned clock rate. When the data word containing the synchronizing bit is read from Note Shift Register 15, its presence is detected by Synch. Bit Detector 40. The detection of a synchronization bit causes Note Select 13 to initiate the effective start of a data transfer cycle. Once a data transfer cycle is initiated for a given note shift register it cannot be interrupted by a demand from any other note shift register.

When a data transfer cycle, starts, Note Select 13 actuates Clock Select 37 so that the Master Clock 12 ceases to time the data address in Main Register 11 and Transient Register 19 and instead the assigned Note Clock 16 is used. During the attack time interval, the data contents in Transient Register 19 are transferred sequentially to Note Select 13. Note Select 13 sends this data to Load Select 14. The Load Select 14 either operates in a manner such that new data is inserted into Note Shift Register 15 or to permit the register to operate in an end-around mode when a data transfer has been completed.

After Note Shift Register 15 has been loaded with data, the data transfer is terminated. The output data from Note Shift Register 15 is converted to an analog voltage by means of Digital-to-Analog Convertor 38. The resultant analog voltage is sent to Sound System 39 to be transformed to audible sounds. Advantageously, Adder-Accumulator 26 contains an accumulator which is modulo 64. 64 is the number of points per cycle of the fundamental frequency of the generated musical notes. If this accumulator is modulo 64 then Sinusoid Table 28 may comprise a read only memory storing 64 values of $\sin(\pi\phi/W)$ for $0 \leq \phi \leq W$ at intervals of $D = 360/64 = 5.625°$. D is called the resolution constant of the sinusoid table.

The circuitry described above facilitates the insertion of a transient voice of any tonal quality within the harmonic capability of the transient data set. The transient voice may contain up to W harmonic components corresponding to the set of harmonic coefficients $d_q$ stored in Transient Harmonic Memory 31. Some or all of these coefficients may be zero-valued. For example, a chiff effect is achieved by using all zero-valued coefficients $d_q$ except for $d_3$ or $d_5$. The result will be a chiff-like augmentation of the third or fifth harmonic of the principle voice determined by the harmonic coefficient set $c_q$. If the transient harmonics $d_q$ are limited to a single value, or to a predetermined number U less than W, Harmonic Counter 24 can be readily modified to terminate the computation cycle at the conclusion of the full use of the number of harmonics U.

Switches 71 and 72 are used to select combinations of the harmonic coefficients $c_q$ and $d_q$. Selections of these sets of harmonic coefficients will determine the quality of the tones sent to the Sound System 39. As described in U.S. Pat. No. 4,085,644, these switches are used to change the tone quality and are commonly called "stops" or tone switches.

Figure 2:
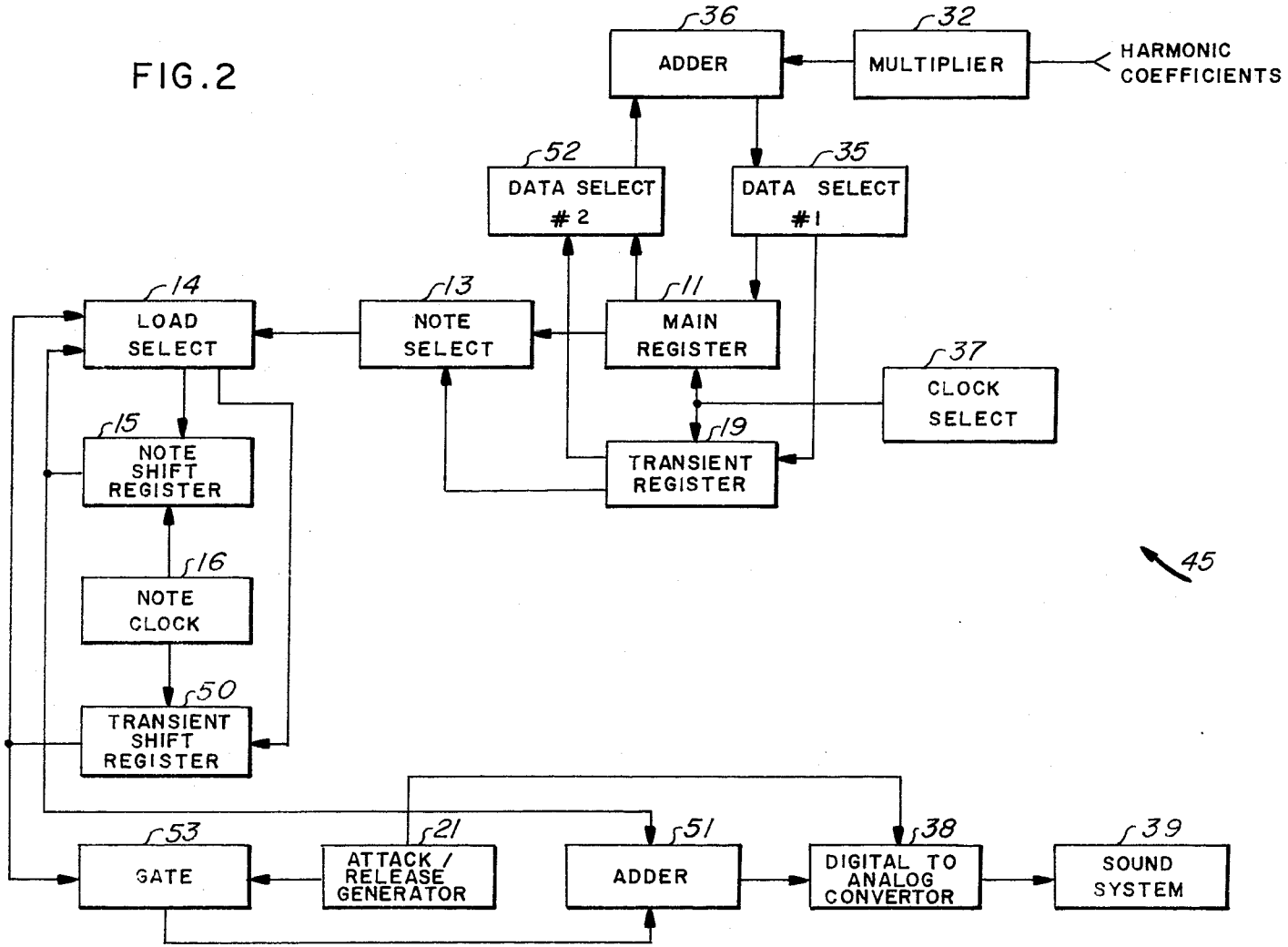
FIG. 2 is an electrical block diagram of an alternate means for producing and using a transient data set.

System 45 shown in FIG. 2 is a modification of the transient voice generator such that it is not necessary to compute a transient data set during each computation cycle. Instead, when any key is first actuated on the instrument's keyboard a complete computation cycle is initiated. During a complete computation cycle, in a manner described below, a master data set corresponding to the relation Equation 1 is computed and stored in Main Register 11. During the second half of a complete computation cycle a transient data set is computed according to the relation $$T(N) = \sum_{q=1}^{U} d_q \sin(\pi Nq/W). \qquad \text{(Equation 3)}$$

The transient data set is stored in Transient Register 19.

A short computation cycle consists of a calculation of only the master data set Z(N).

Data Select No. 1 35, as employed by system 45 shown in FIG. 2, operates such that during the first part of a complete computation cycle, the output data from Adder 36 is directed only to Main Register 11. During this same portion of a complete computation cycle, Data Select No. 2 52 selects the data read out of Main Register 11 and transfers this data as an input to Adder 36. This same selection by the two data select logic blocks occurs during the entire interval of a short computation cycle.

For the second half of a complete computation cycle, Data Select No. 2 52 transfers the data read out of Transient Register 19 to Adder 36. The summed data output from Adder 36 is transferred to Transient Register 19 via Data Select No. 1 35.

The operation of the logic blocks preceding and including Adder 36 for System 45 is the same as that previously described for System 10 shown in FIG. 1.

At the completion of a complete computation cycle, a data transfer cycle is initiated as described previously. During a data transfer cycle, the data stored in Main Register 11 is transferred to an assigned Note Shift Register 15 by a selection made by Note Select 13. When the data transfer has been finished, Note Select 13 upon detection of a synchronizing bit from Transient Shift Register 50 allows the transfer of data from Transient Register 19 to Transient Shift Register 50 via Load Select 14.

Note Clock 16 is assigned a frequency corresponding to a note actuated on the keyboard. This note clock causes data to be read out simultaneously and at the same rate from both Note Shift Register 15 and Transient Register 50. Attack/Release Generator 21 causes Gate 53 to transfer data read out from Transient Shift Register 50 to be transferred as an Input to Adder 51. The second input to Adder 51 is the data read out of Note Shift Register 15. Gate 53 is allowed to transfer data only during the attack interval of a musical note. After the attack interval Gate 53 inhibits the transfer of data. The net result is that the sum combination of the principle voice and the transient voice is created by Adder 51 and delivered to Digital-to-Analog Convertor 38.

It is apparent that a comlete computation is only required in System 45 when either a key is first actuated on the keyboard or when a new selection is made for the harmonic coefficients $d_q$ which are used in the computation of the transient data set. Therefore, a complete computation cycle can be initiated upon the detection of a change in the switches controlling the selection of harmonic data sets $d_q$. Such a detection system is well known in the art of digital logic design.

Figure 3A:
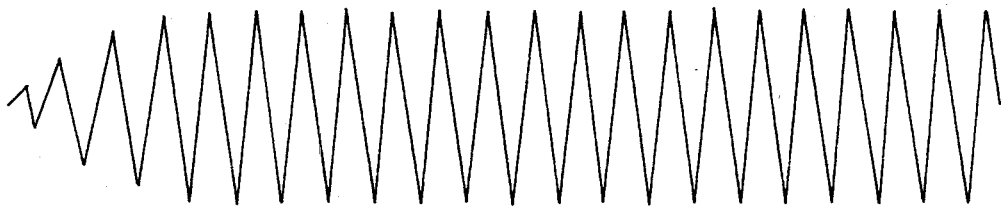
FIG. 3*a* shows the waveshape of the principal generated waveshape.
Figure 3B:
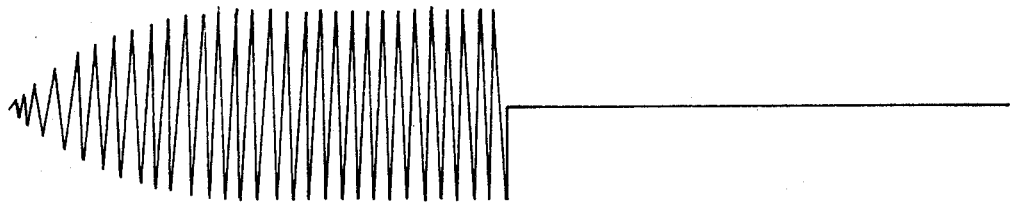
FIG. 3*b* shows the waveshape of the transient voice with abrupt termination.
Figure 3C:
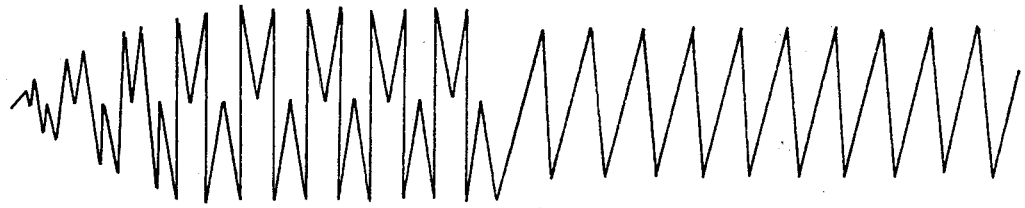
FIG. 3*c* is the sum combination of the waveshapes of FIG. 3*a* and FIG. 3*b*.

FIGS. 3*a*, 3*b*, and 3*c* illustrate the insertion of a transient voice as described above for either System 10 or System 45. The wave shape shown in FIG. 3*a* represents the principal tone generated by the Polyphonic Tone Synthesizer using only the set of harmonic coefficients $c_q$. For simplicity, this waveshape is shown as a sinusoid, however more typically it would be a complex waveshape. The gradual increase in amplitude is typical of the attack time variation introduced by the ADSR generator. The inserted transient voice is shown in FIG. 3*b*. This waveshape is caused to terminate abruptly at a time interval closely following the end of the attack interval. FIG. 3*c* shows the combination of the principal and transient wave forms.

Figure 4:
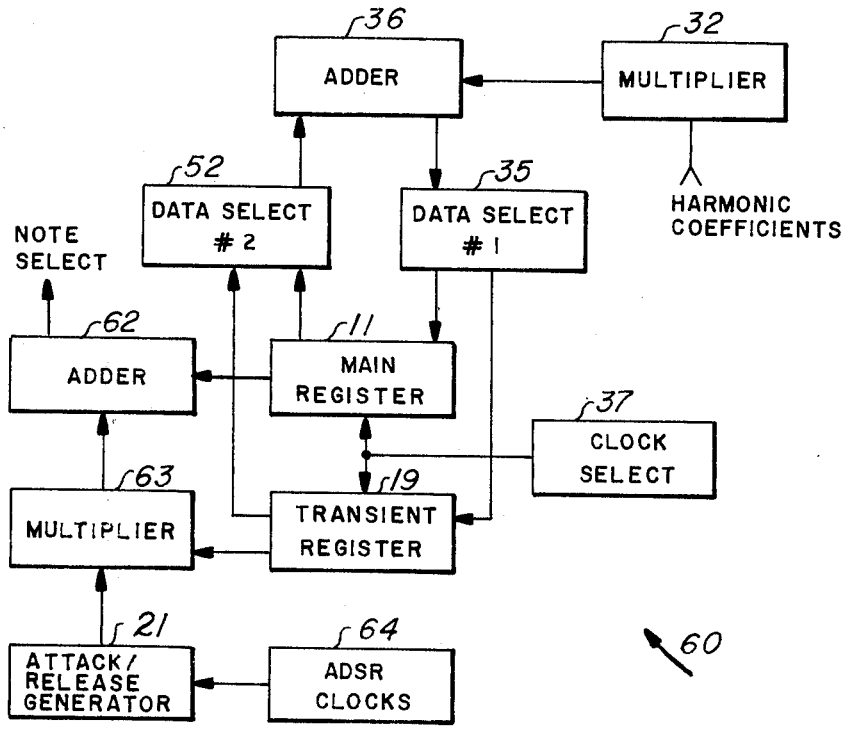
FIG. 4 is an electrical block diagram of an alternate method of generating a transient voice with independent attack/release envelope modulation.

Instead of terminating the transient voice aburptly, it may be desirable to decrease the amplitude gradually. Moreover, instead of having the transient voice terminate before the principal voice, pleasant musical effects are attained by either playing the transient voice by itself or by having the transient voice continue after the principal voice has been reduced to zero amplitude. A means for having independent control of the envelope of the transient voice is that of System 60 shown in FIG. 4.

Data Select No. 1 35 and Data Select No. 2 52 operate as described previously in conjunction with System 45 of FIG. 2 so that at the end of a computation cycle a master data set is stored in Main Register 11 and a transient data set is stored in Transient Register 19.

When a transfer cycle is initiated for a selected note shift register, data is simultaneously read out of both Main Register 11 and Transient Register 19 at a rate determined by an associated note clock. The data read of Main Register 11 is one input to Adder 62. The data read out of Transient Register 19 is multiplied by Multiplier 63 with a scale factor furnished from the Attack-/Release Generator 53. The scale factor is timed by the ADSR clocks 64 in such a manner that the data read out from Transient Memory 19 is caused to gradually increase in amplitude in the time interval during the attack interval of the musical note's waveshape and to gradually decrease in amplitude at a preselected time interval after the end of the attack. The decrease in amplitude can occur automatically at the end of the attack or can be timed to start when the key actuated on the keyboard is released. Means for generating amplitude scale factors that can advantageously be used for Attack/Release Generator are described in the referenced copending U.S. Pat. Application No. 652,217.

Figure 3D:
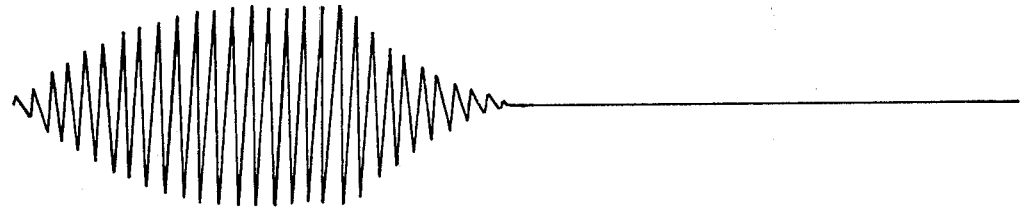
FIG. 3*d* is the waveshape of the transient voice with independent attack/release envelope modulation.
Figure 3E:
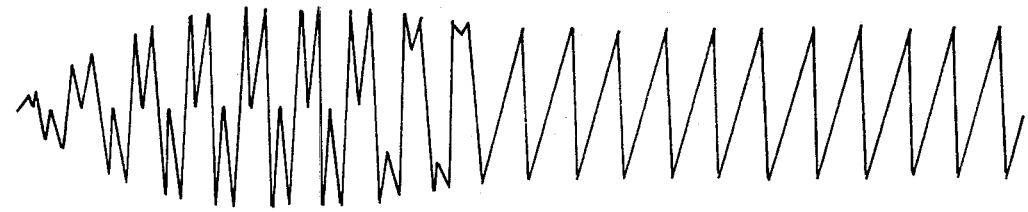
FIG. 3*e* is the sum combination of the waveshapes of FIG. 3*a* and FIG. 3*d*.

FIGS. 3*d* and 3*e* illustrate the insertion of a transient voice as described above for System 60 of FIG. 4. The wave shape shown in FIG. 3*a* represents the principal tone generated by the Polyphonic Tone Synthesizer using only the set of harmonic coefficients $c_q$. The inserted transient voice is shown in FIG. 3*d*. The waveshape can be generated to have abrupt build-up and decrease of amplitude or can have the gradual changes illustrated in the Figure. The choice of the type of envelope variation is controlled by the scale factors generated by Attack/Release Generator 53. FIG. 3*e* shows the combination of the principal and transient wave forms.

It is apparent that the various systems described above are equally applicable when the sinusoid table is replaced by a table of generalized harmonic functions. The term generalized harmonic functions is used herein in the generic sense to include functions such as the Walsh, Bessel, and trigonometric functions as well as to include orthogonal polynomials such as Legendre, Gegenbauer, Jacobi, and Hermite.

It is well-known in mathematical art that for a period of a waveshape, such as a musical waveshape, a generalized harmonic series can be used to represent the waveshape. Such generalized harmonic series include but are not limited to a Fourier series of the types shown in Equations 1, 2, and 3. The generalized harmonic series corresponding to Equation 1 is $$Z'(N) = \sum_q a_q \phi_q(N) \qquad \text{(Equation 4)}$$

corresponding to Equation 2:

$$T'(N) = \sum_q a_q \phi_q(N) + \sum_q b_q \phi_q(N) \qquad \text{(Equation 5)}$$

where $\phi_q(N)$ denotes any of the various members of the family of orthogonal functions or orthogonal polynomials. By analogy with conventional Fourier series, the coefficients $a_q$ and $b_q$ are called generalized Fourier harmonic coefficients. Frequently equations of the form of Equation 4 and Equation 5 are called a discrete generalized Fourier transform. The individual terms in the summations are called constituent generalized Fourier components of the associated generalized harmonic coefficients.

While a digital mechanization has been described, this is not necessary. All the system functions could be carried out in an equivalent analog form, the various shift registers being substituted for by analog units such as "bucket brigade" charge-coupled devices.

Intending to claim all novel, useful and unobvious features shown or described the applicant makes the following claims:

1. In a musical instrument of the type including a keyboard having a plurality of key-operated switches, a plurality of tone setting stop switches, generation means for synthesizing a musical waveshape by calculating its constituent generalized Fourier components and wherein each Fourier component is established by a harmonic coefficient associated with the corresponding Fourier component, said generation means including first circuitry operative during a computation cycle for individually calculating the constituent Fourier components and an accumulator for summing these Fourier components to form a master data set in which the relative values of the words are established by a set of harmonic coefficients selected in response to the setting of said stop switches and second circuitry having a plurality of registers for receiving transferred master data set words, and a convertor means for generating analog output musical waveshapes from data read out of registers by associated clock generators; the improvement for time variant modification of the synthesized musical waveshapes comprising;

means for computing a master data set and a transient data set during a computation cycle, a first storage means comprising a first memory means for writing said master data set to be thereafter read out and a second memory means for writing said transient data set to be thereafter read out, a third memory means for writing input data to be thereafter read out, means for repetitiously reading out data stored in said first storage means at selected rates, a transient signal control generator wherein a select signal is created in response to actuation of said key-oriented switches, and select means responsive to said select signal whereby data is selectively read out from said first memory means or is selectively read out from said second memory means and the selected data is transferred and caused to be written into said third memory means thereby producing said time variant modification of the synthesized musical waveshape.

2. In a musical instrument according to claim 1 wherein said transient signal control generator further comprises;

detect circuitry means responsive to actuation of members of said plurality of key-operated switches whereby a detect signal is created when a switch is closed, and envelope generation means comprising circuitry for timing envelope modulations of said musical waveshape wherein said timing is initiated by said detect signal and whereby said select signal is generated at a selected time interval following timing initiated by detect signal.

3. In a musical instrument according to claim 1 wherein said means for computing further comprises;

first means for computing numbers Z(N) in said master data set in accordance with the relation $$Z(N) = \sum_{q=1}^{W} c_q \sin(\pi N q/W)$$

where $q=1,2,\ldots,W$, $N=1,2,\ldots,2W$ and W is the number of harmonic components defining said numbers Z(N) in said master data set, $c_q$ is the harmonic coefficient in the corresponding $q^{th}$ harmonic component; and for computing numbers T(N) in said transient data set in accordance with the relation $$T(N) = \sum_{q=1}^{U} d_q \sin(\pi N q/W) + Z(N)$$

where U is the number of harmonic components defining said transient voice constituent numbers T(N) in said transient data set and $d_q$ is the harmonic coefficient in the corresponding $q^{th}$ harmonic component said first means comprising;

a fourth memory storing said harmonic coefficients $c_q$, a fifth memory storing said harmonic coefficients $d_q$, a sinusoid table comprising a memory storing values of $\sin(\pi\phi/W)$ for $0 \leqq \phi \leqq 2W$ at intervals of D where D is a resolution constant, harmonic evaluation circuitry utilizing said sinusoid table and said fourth memory to calculate $c_q \sin(\pi N q/W)$ and said fourth memory to calculate $d_q \sin(\pi N q/W)$ for each of the harmonic coefficients in accordance with a selected value of N; and means for selectively successively algebraically summing output of said harmonic evaluation circuitry with contents of word N in said first storage means whereby numbers Z(N) are caused to be stored in said first memory means and numbers T(N) are caused to be stored in said second memory means.

4. In a musical instrument according to claim 1 wherein said select means further comprises;

select data circuitry responsive to said select signal whereby if select signal is created data read out from said second meory means is selectively transferred and caused to be written into said third memory means and whereby if select signal is not created data read out from said first memory means is selectively transferred and caused to be written into third memory means thereby producing said time variant modification of the synthesized musical wave shape.

5. In a musical instrument according to claim 2 wherein said means for computing further comprises;

first means for computing numbers Z(N) in said master data set in accordance with the relation $$Z(N) = \sum_{q=1}^{W} c_q \sin(\pi Nq/W)$$

where $q=1,2, \ldots ,W$; $N=1,2, \ldots ,2W$ and $W$ is the number of harmonic components defining said numbers Z(N) in master data set, $c_q$ is the harmonic coefficient in the corresponding $q^{th}$ harmonic component; and for computing numbers T'(N) in said transient data set in accordance with the relation $$T'(N) = \sum_{q=1}^{U} d_q \sin(\pi Nq/W)$$

where U is the number of harmonic components defining said numbers T'(N) in said transient data set and $d_q$ is the harmonic coefficient in the corresponding $q^{th}$ component; wherein said computation cycle comprises a first and second subcomputation cycle, said first means comprising;

a fourth memory storing said harmonic coefficients $c_q$, a fifth memory storing said harmonic coefficients $d_q$, a sinusoid table comprising a memory storing values of $\sin(\pi\phi/W)$ for $0 \leqq \phi \leqq 2W$ at intervals of D where $D$ is a resolution constant, harmonic evaluation circuitry utilizing said sinusoid table and said fourth memory to calculate $c_q \sin(\pi Nq/W)$ during said first subcomputation cycle and said fifth memory to calculate $d_q \sin(\pi Nq/W)$ during said second subcomputation cycle for each of the harmonic components in accordance with a selected value of N; and second means for selectively successively algebraically summing output of said harmonic evaluation circuity with contents of word N in said first storage means whereby numbers Z(N) are caused to be stored in said first memory means and numbers T'(N) are caused to be stored in said memory means.

6. In a musical instrument according to claim 5 wherein said third memory means comprises;

a principal memory for writing said master data set to be thereafter read out, a transient memory for writing said transient data set to be thereafter read out, said select means further comprising circuitry responsive to said select signal whereby data read out from said first memory means is transferred and caused to be written in said principal memory and whereby data read out from said second memory means is caused to be written in said transient memory, and means for repeatedly reading out data in synchronism from said principal memory and said transient memory at a rate determined by said associated clock generator, said read out data being provided to said convertor means.

7. In a musical instrument according to claim 6 wherein said convertor means comprises;

digital-to-analog convertor means for converting input digital data to analog output signals having a fundamental frequency determined by a selected key on said keyboard and a waveshape determined by the setting of said stop switches, and adder means responsive to said select signal wherein data read out from said principal memory and said transient memory are algebraically summed and transferred as input data to said digital-to-analog convertor means when said select signal is generated and wherein when select signal is not generated data read out from said transient memory is not algebraically summed thereby data read out from said principal memory is transferred as input data to digital-to-analog convertor means thereby producing said time variant modification of the synthesized musical wave shape.

8. In a musical instrument according to claim 5 wherein said envelope generator means comprises;

amplitude generation means responsive to said detect signal wherein a sequence of envelope amplitude scale factors are generated at a selected rate.

9. In a musical instrument according to claim 8 further comprising;

envelope multiplication means whereby numbers T'(N) read out from said second memory means are multiplied by envelope amplitude scale factors generated by said amplitude generation means thereby producing scaled transient numbers, transient adder means wherein said scaled transient numbers are algebraically summed with numbers Z(N) read out from said first memory means, and transfer means whereby algebraically summed numbers produced by said transient adder means are caused to be written in said third memory means.

* * * * *

UNITED STATES PATENT AND TRADEMARK OFFICE

CERTIFICATE OF CORRECTION

PATENT NO. : 4,122,742

DATED : October 31, 1978

INVENTOR(S) : Ralph Deutsch

It is certified that error appears in the above-identified patent and that said Letters Patent are hereby corrected as shown below:

| | Reads | Should Read |
|---|---|---|
| column 12, line 3 | key-oriented | key-operated |
| column 13, line 26 | T(N)= | T'(N)= |
| column 13, line 55 | said memory | said second memory |

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*